United States Patent [19]

Graham

[11] 4,433,538

[45] Feb. 28, 1984

[54] TEXTILE SPINNING MACHINES

[76] Inventor: John F. Graham, 33 Dudley Dr., Hyndland, Glasgow, Scotland

[21] Appl. No.: 253,397

[22] Filed: Apr. 13, 1981

[30] Foreign Application Priority Data

Apr. 17, 1980 [GB] United Kingdom ..... 8012722
Apr. 17, 1980 [GB] United Kingdom ..... 8012723

[51] Int. Cl.[3] ..... D01H 7/92; D01H 13/10; D01H 5/28

[52] U.S. Cl. ..... 57/328; 57/344; 57/346; 57/348

[58] Field of Search ..... 57/332, 331, 329, 328, 57/334, 344, 346, 348, 280

[56] References Cited

U.S. PATENT DOCUMENTS

| | | | |
|---|---|---|---|
| 760,619 | 5/1904 | Fredenburgh | 57/280 |
| 1,772,109 | 8/1930 | Quaas | 57/328 |
| 2,557,104 | 6/1951 | Hegedus | 57/346 X |
| 3,276,196 | 10/1966 | Grunder | 57/328 |

*Primary Examiner*—Donald Watkins

*Attorney, Agent, or Firm*—W. Thad Adams, III

[57] ABSTRACT

The invention is concerned with a textile spinning machine particularly a ring spinning machine, and is directed to the provision of a tension reliever between the delivery rollers and the yarn balloon, which has the effect of producing a tension differential between the yarn forming the balloon, and the yarn travelling from the delivery rollers to the tension reliever. In order to facilitate piecing-up of the yarn after a breakage, the tension reliever has a drive wharf and a capstan device which includes a yarn engaging capstan element, the capstan device permitting threading in a radial direction, and having a snap-in connection with the wharf, so that the capstan device can be completely detached from the drive wharf for a piecing-up operation. The tension reliever itself has a hollow body rotatable about an axis substantially coincident with the path of the yarn and a capstan element in the form of a rod having a yarn engaging section extending close to the axis of rotation and a hook portion at the distal end to prevent the yarn sliding off the yarn engaging section.

10 Claims, 12 Drawing Figures

TEXTILE SPINNING MACHINES

Figure 1:
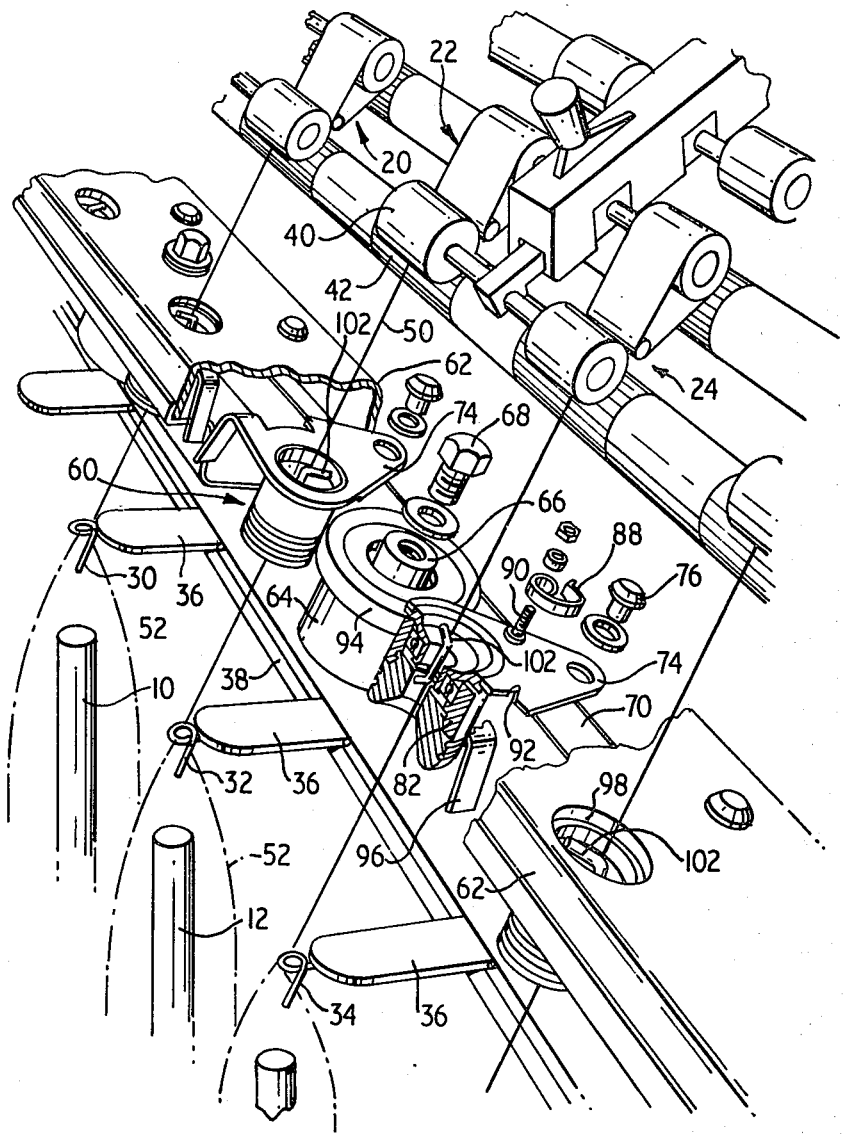

The present invention is concerned with spinning machines of the kind in which the yarn forms a balloon between the delivery position and the yarn package and the invention is particularly useful in a ring spinning machine.

An important factor limiting the production rate of a continuous spinning process, such as ring spinning, is the end-breakage rate, i.e. the number of yarn breakages which occur in a given period of time. Such yarn breakages occur whenever the tension in the yarn exceeds the strength of the yarn at the weakest place between the delivery device (usually the front roller of a drafting system) and the position at which the spun yarn is wound on to a yarn carrier.

End breakage rate is important in spinning mills, because of the loss in production which occurs each time a yarn breaks, and because of the labour costs incurred in repairing the breakages. If fact, in order to keep the end breakage rate down to an acceptable level, it is often necessary to restrict the speed of the spindles.

Both the yarn tension and the strength of the yarn are variable, and most improvements directed towards reducing end breakage rate, have been concerned with producing an even tension in the yarn. It has generally been assumed that little could be done to counteract the effect of weak places in the yarn. The present invention is based on the observation, that the strength of the yarn during the spinning process, is considerably less than the strength of the spun yarn. This is because a weak zone exists in the yarn, as it emerges from the front rollers. In this zone, just beyond the nip of the front rollers, the yarn appears to form a thin web of untwisted fibres emerging from the roller nip. In fact, this zone where there is a thin web of untwisted fibres can be observed with the naked eye on a spinning frame, and clearly this must present the weakest section of the yarn between the front rollers and the yarn package on the spindle.

The present invention is concerned with the separation of this zone of substantially untwisted yarn, from the tension which is required in the spinning balloon, whilst at the same time allowing uninhibited twisting of the yarn to occur between the front rollers and the traveller or like spinning device.

Throughout this specification, the expression "yarn" is intended to comprehend any thread-like element made up of staple fibres, natural or synthetic, and includes substantially untwisted slubbings or rovings, as well as partially twisted or fully twisted yarns and threads. In an attempt to reduce the end-breakage rate in spinning machines of this kind, there have been various proposals to emply a false twist device located between the delivery position (usually the nip of a pair of drafting rollers) and the position at which the balloon effect begins (usually the guide eye). Although the function of such a device has been regarded primarily as that of introducing twist into the yarn in the region where the yarn is weakest, that is to say where the yarn is leaving the delivery position, perhaps an even more important function is that of providing a tension differential in the yarn so that the tension in the yarn leaving the delivery device is lower than the tension in the yarn at the balloon. Admittedly, the guide eye itself must have some slight tension differential effect, but the introduction of a false twist device which actually nips the yarn has a more pronounced tension differential effect. For this reason, it is better to refer to the false twist device as a tension reliever—and this expression will be used hereinafter—but since the tension reliever has to rotate in sympathy with the balloon, to allow twist to be imparted to the yarn between the delivery position and the tension reliever, and since the twist is inhibited from travelling along the yarn by the guide eye, the tension reliever will incidentally create false twist in the yarn.

Now because the tension reliever has to grip the yarn in some way, it is necessary to thread the yarn through it each time there is a yarn breakage. This threading operation can call for a certain dexterity, and is in any case somewhat tedious and therefore time consuming. It is an object of this invention to provide a tension reliever for a textile spinning machine, which can be easily and quickly threaded by the operative.

It is a further object of the present invention to provide a spinning machine with a tension reliever, which is of relatively simple construction, and which at the same time is versatile, in that it permits variation in the tension differential effect which can be obtained.

According to this invention a tension reliever for use in a textile spinning machine comprises a drive wharf adapted to be rotated about its own axis by a driving device in the machine, and a capstan device comprising a hollow body carrying a capstan element for the yarn, the capstan device having a releasable connection with the wharf, so that when engaged with the wharf it is adapted to be supported by and to rotate therewith (to rotate the capstan device) but so that it can be completely and easily removed from the wharf for the purpose of threading-up the yarn.

In the preferred construction, the hollow body has a snap-in connection with the wharf. It is further preferred that the capstan device is formed so that it permits yarn to be passed in a radial direction through its hollow body and engaged with the capstan element therein.

Preferably, one or both of the wharf and the hollow body is or are made of resilient material which permits the necessary distention and/or compression required during a snap-in fitting operation. It is further preferred, that the resilient wharf and/or hollow body does not form a complete annulus, so that it is able to distend or contract as required during a snap-in fitting operation.

If the hollow body were in the form of a complete annulus, so that it formed an eye through which the thread had to be passed in an axial direction, and if in addition, the capstan device were permanently secured to the wharf, then threading up of the tension reliever after a yarn breakage, would be a delicate and tedious operation. It would be necessary to pass the yarn through the eye formed by the hollow body, and at the same time ensure that the yarn is engaged around the capstan element. In contradistinction to this, with the tension reliever in accordance with the invention, threading-up is a relatively simple operation, mainly because the capstan device is completely removed from the wharf, and therefore there is no accessibility problem, and partly because the yarn can be passed radially through the wall of the hollow body, without the necessity for threading it in an axial direction through the hollow body.

According to a preferred feature of the invention, the tension reliever also comprises a hollow axle and a journal bearing arranged between the hollow axle and the wharf. It is preferred that the capstan element extends axially from the hollow body into the hollow axle, when the hollow body is connected to the wharf. In the preferred construction, the hollow axle, wharf and hollow body are all substantially cylindrical members and the bore of the wharf is formed with an annular groove of rounded cross-section, the hollow body having an external rib of cross-section corresponding to the groove, the rib being a tight fit in the groove, to permit the snap-in interconnection between the wharf and the capstan device.

During a threading-up operation, it is of course necessary to pass the yarn axially through the bore of the hollow axle, but since the capstan device itself will have been removed from the wharf and the hollow axle at that time, this presents no problem, because the bore of the hollow axle can be relatively large, and relatively short in axial length.

The invention also includes a spinning machine fitted with a tension reliever in accordance with the invention located between a yarn delivery position and a yarn balloon position. In the preferred construction, the hollow axle of the tension reliever is carried by a plate movable between operative and inoperative positions, there being driving means on the machine engageable with the wharf when the plate is in the operative position and brake means on the machine engageable with the wharf when the plate is in the inoperative position.

According to another aspect of the invention, a spinning machine has a tension reliever between a yarn delivery position and a twist inserting device, the tension reliever comprising a hollow body adapted to be rotated about an axis substantially coincident with the path of the yarn and a capstan element carried by the hollow body, so that the yarn can be threaded through the body and wrapped around the capstan element, the capstan element comprising a rod having a yarn-engaging section extending close to the axis of rotation of the body and a hook portion at the distal end of the yarn-engaging section to prevent the yarn sliding off the yarn-engaging section.

With an arrangement of this kind, the tension differential is obtained by the simple expedient of winding the yarn around the capstan element, and since that element is simply a rod, the winding of the yarn on to the capstan element is extremely simple. Also, since the tension differential is obtained by this very simple capstan element, it is possible to vary the differential effect, by varying the winding of the yarn around the capstan element, so that the angle of engagement of the yarn with the capstan element is varied. Moreover, since the yarn engaging section of the capstan element extends close to the axis of rotation of the body, a minimum strain is applied to the yarn during the spinning operation by the tension reliever, and consequently yarn breakages due to the action of the tension reliever itself are minimised.

Preferably, a root section of the capstan element is embedded in the hollow body. It is further preferred, that the yarn-engaging section of the capstan element extends parallel with the rotational axis of the body, and the hook portion may extend substantially radially.

In one form of the invention, the capstan element is substantially Z-shaped and the yarn engaging section crosses the axis of rotation.

It will be appreciated, that in practice, a tension reliever in accordance with the invention will be provided at each spindle position along the length of a spinning machine.

Figure 2:
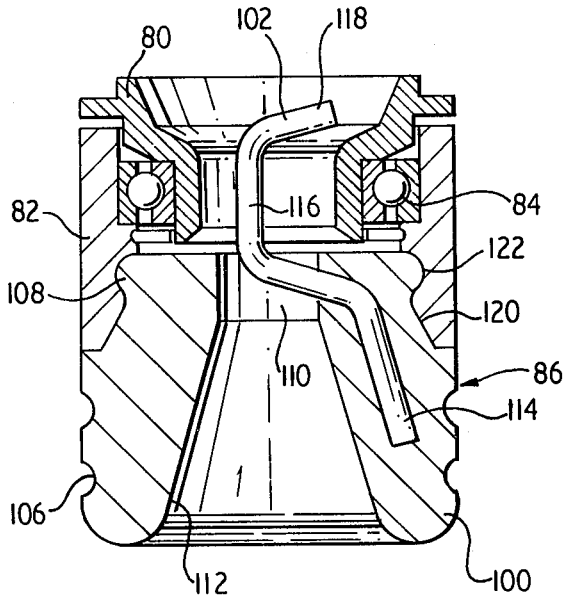
Figure 3:
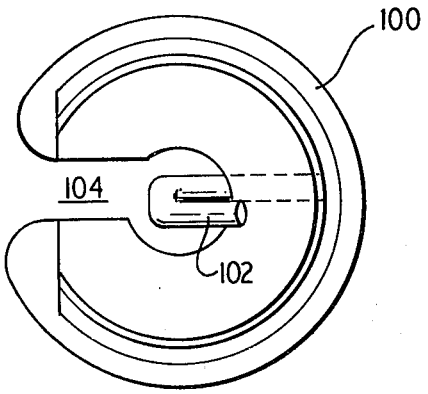
Figure 4:
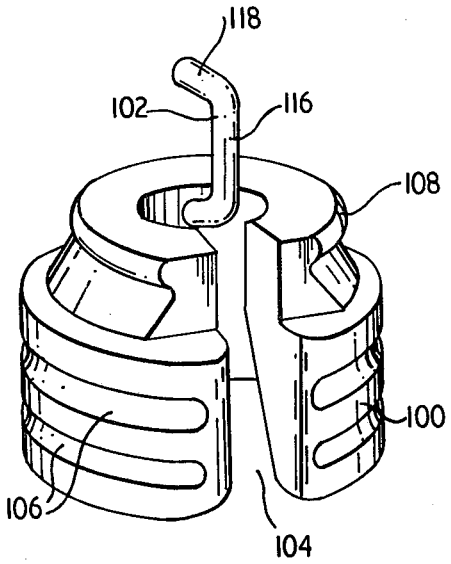
Figure 8:
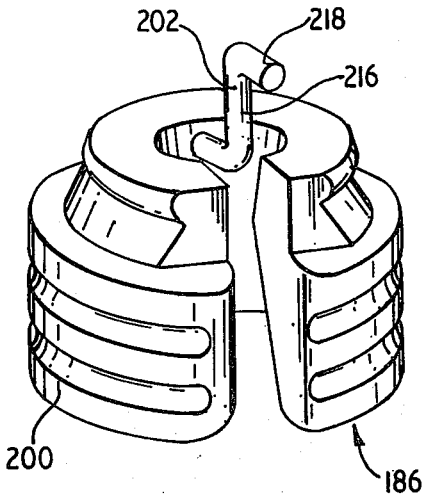
Figure 7:
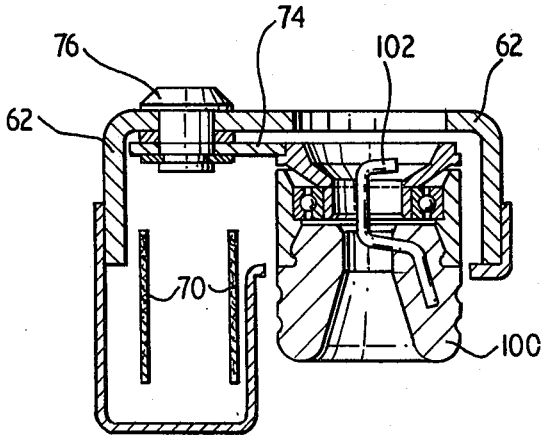
Figure 6:
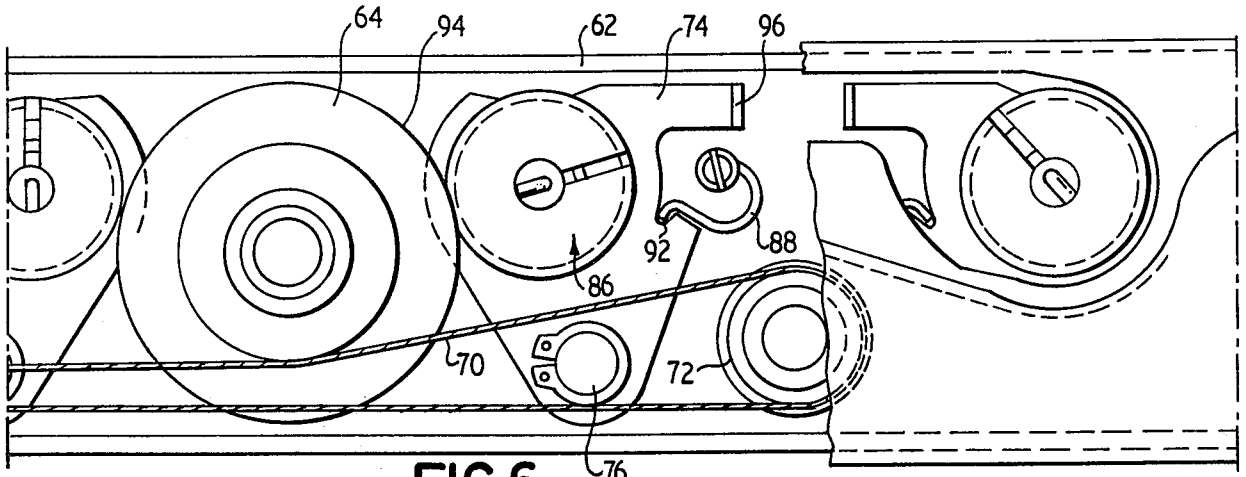
Figure 5:
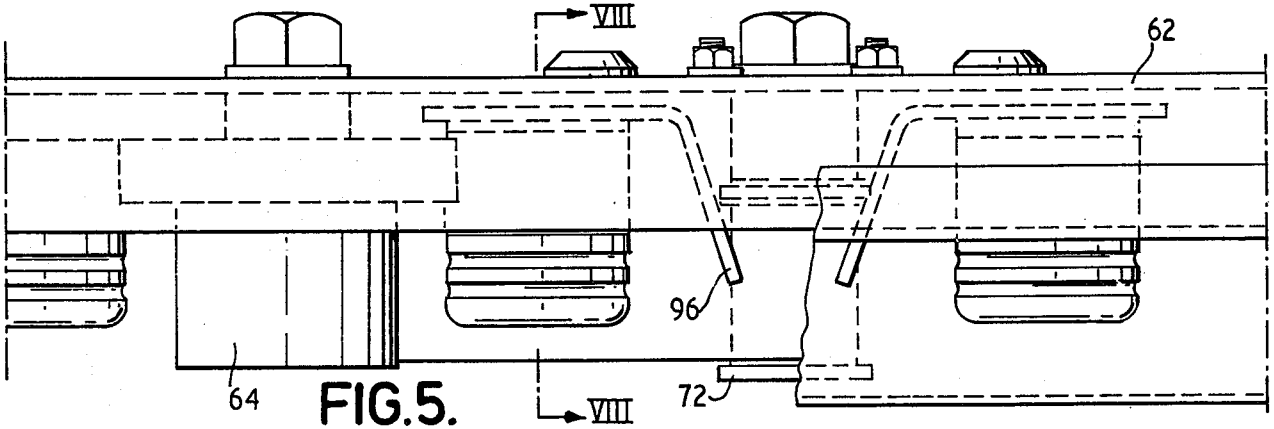
Figure 9:
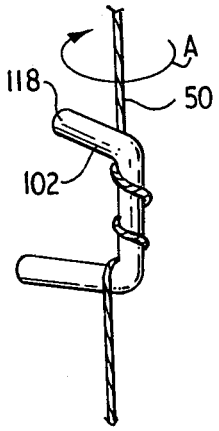
Figure 10:
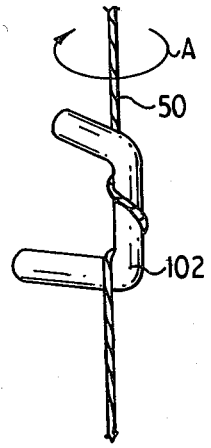
Figure 11:
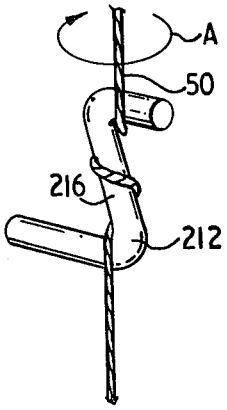
Figure 12:
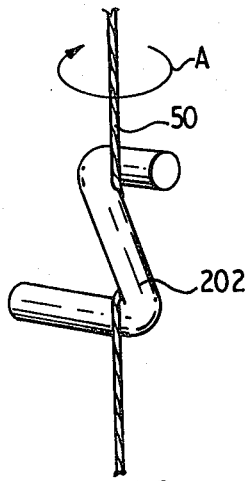

An arrangement of a ring spinning machine in accordance with the invention, will now be described by way of example only, with reference to the accompanying drawings, in which:

FIG. 1 is a partly sectional and partly "exploded" view of a spinning machine, illustrating the location of a tension reliever in accordance with the invention, FIG. 2 is a longitudinal section through a tension reliever, FIG. 3 is a plan view of a capstan device for the tension reliever shown in FIG. 2, FIG. 4 is a perspective view of a capstan device shown in FIG. 3, FIG. 5 is an elevation of part of a mounting arrangement for a series of tension relievers, part of which is cut away, FIG. 6 is an underneath view of the arrangement shown in FIG. 5, FIG. 7 is a section on the line VII—VII in FIG. 5, FIG. 8 is a perspective view similar to FIG. 4, but illustrating a capstan device with an alternative form of capstan element, FIG. 9 is a diagram showing a yarn winding with a capstan device as shown in FIG. 4, FIG. 10 is a diagram similar to FIG. 9, but showing an alternative yarn winding, FIG. 11 is a diagram showing a yarn winding with a capstan device as illustrated in FIG. 8, and FIG. 12 is a diagram similar to FIG. 11, but showing an alternative yarn winding.

In FIG. 1 there is illustrated part of a generally conventional ring spinning machine, which has been fitted with a tension relieving system in accordance with the invention. Two yarn spindles are shown at 10 and 12, and it will be appreciated, that the machine is equipped with a number of these spindles arranged in a row as is usual in this type of machine. Some distance above the spindles 10 and 12, there are corresponding drafting arrangements 20 and 22, and a third drafting arrangement 24 appertaining to an adjoining spindle (not shown) is also illustrated. A series of pigtail wire guide eyes 30, 32 and 34 each of which is associated with a corresponding spindle is also provided on the machine, the guide eyes being carried by brackets 36 extending from a fixed rail 38 which forms part of the machine structure.

In the ring spinning machine, a single sliver 50 from a supply package (not shown) is taken through the drafting device 22, and emerges from the nip of a pair of front rollers 40 and 42. The sliver 50 then passes in a substantially straight line to the corresponding guide eye 32, below which, it forms a spinning balloon indicated at 52, when the machine is in operation. This path of the sliver 50, which is being formed into a yarn by the spinning process, is repeated at each spindle position along the length of the machine, but as the arrangement is the same at each position, it is only necessary to describe what happens at a single position.

The spindle 10,12, is rotated at high speed, and owing to the frictional retardation of the traveller (not shown) as it slides around the spinning ring, tension is induced in the yarn between the traveller and the nip of the front rollers 40 and 42. Twist is introduced into the yarn by the action of the ring traveller, and this twist runs back up the yarn from the guide eye 32, to the nip of the front rollers 40 and 42. However, close observation shows that as the substantially untwisted yarn emerges from the nip of the rollers 40 and 42, there is a very short V-shaped section of substantially untwisted yarn extending from the nip of the rollers, to a position where the twist begins to form in the yarn. It is this region which normally forms the weakest part of the yarn between the nip of the front rollers 40 and 42 and the traveller, and consequently most end breakages are likely to occur at this point. In fact, published information indicates, that the strength of the yarn in this very short V-shaped region is likely to be only about 40% strength of the twisted yarn where it is wound on to the package on the spindle.

With a view to minimising the number of end breakages, during a spinning operation, a yarn tension reliever indicated generally at 60 is provided on the machine, in association with each spindle position, and the yarn 50, is passed through the tension reliever 60. For the purpose of mounting the tension relievers 60 on the spinning machine, there is an inverted channel-shaped rail 62 extending along the length of the machine, and rigidly secured to the machine framework. As illustrated in FIGS. 1, 5 and 6, the rail 62 provides a mounting for a series of driving rollers 64, there being one such driving roller 64 located between each adjacent pair of tension relievers 60. Each driving roller is free to rotate on a fixed axle 66 secured to the mounting rail 62 by a setscrew 68, and there is a driving belt 70 which extends along the length of the mounting rail 62, on the underside thereof (see especially FIG. 7) there being a driving mechanism (not shown) at one end of the machine for traversing the belt at relatively high speed. The belt 70 engages with a boss forming part of each driving roller 64, and there is an arrangement of jockey pulleys 72, which ensures that the belt 70 is pressed firmly against each of the driving rollers 64. Hence, during operation of the machine, the belt 70 causes each of the driving rollers 64 to be rotated about its own vertical axis.

Each tension reliever 60 is carried by a plate 74 mounted inside the channel-shaped mounting rail 62, and pivoted on a pin 76 (see FIG. 7).

The tension reliever 60 essentially comprises a hollow axle 80, secured to the pivoted plate 74, a drive wharf 82 rotatably mounted on the axle 80 by means of a ball-bearing 84, and a capstan device 86 detachably connected to the drive wharf 82 as will be hereinafter described. The axle 80 may be made as a diecasting, or moulded in plastics material, and its function is simply that of providing a location for the inner race of the ball-bearing 84, the drive wharf 82 being a press-fit on the outer race of the ball-bearing.

Now the pivoted plate 74 is loaded by a spring 88, one end of which is secured to a setscrew 90 fastened into the mounting rail 62, the other end being hooked into a notch 92 formed in the pivoted plate 74. The arrangement of the spring 88, is such that it provides an "over centre" arrangement for the plate 74, whereby the latter is spring loaded into either of two positions. One of these, the operative position is illustrated in FIG. 6, wherein the drive wharf 82 is pressed into engagement with a periphery 94 of the driving roller 64, whereby when the driving roller is rotated, this produces rotation of the driving wharf 82, as permitted by its journal mounting on the hollow axle 80. Also, since the capstan device 86 is secured to the drive wharf 82, the capstan device will also rotate about the longitudinal axis formed by the bearing 84, and passing through the centre of the hollow axle 80. On the other hand, when the pivoted plate 74 is moved into its inoperative position, the drive wharf 82 is engaged with a brake pad (not shown) attached to the inside of the mounting rail 62, whereby rotation of the drive wharf 82 and the capstan device 86 can be very rapidly arrested. Hence, so long as the pivoted plate 74 is in the operative position, the capstan device 86 is rotated at a high speed, but as soon as the plate 74 is moved through an angle sufficient to pass over centre, the spring loading provided by the spring 88, forces the tension reliever into the inoperative position, where rotation of the capstan device ceases almost immediately. For the purpose of moving the tension reliever between its operative and inoperative positions, there is a finger 96 projecting downwardly from the plate 74, to a position, where it is accessible beneath the mounting rail 62. In fact, as illustrated in FIG. 5 the finger 96 projects below the mounting rail 62.

A hole 98 is formed in the mounting rail 62 at each position corresponding to the operative position of one of the tension relievers, so that the axis of each tension reliever, is coaxial with the corresponding hole 98 in the mounting plate 62, whenever the tension reliever is in the operative position.

Turning now to FIGS. 2, 3 and 4, the capstan unit 86 essentially consists of a generally annular hollow body 100, and a capstan element 102. The hollow body 100 is moulded in plastics material, which has adequate strength, but which also possesses a degree of resilience. As is clear from FIGS. 3 and 4, the hollow body 100 does not subtend a full 180° about the vertical axis, but has a radial gap 104 formed through its wall, this gap extending throughout the axial length of the body 100. The lower portion of the body 100 is of the same external diameter as the drive wharf 82, and is formed with external grooves 106 which facilitate the gripping of the body 100 by the hand of an operative, and the upper portion of the body 100 is of somewhat reduced outside diameter and is formed with a rib 108 of substantially semi-cylindrical cross-section (see FIG. 2) at its top end. Internally, the body 100 has a relatively small bore 110 at its upper end and a frusto-conical bore 112 in its lower portion.

The capstan element 102 takes the form a rod-like member made in metal, a root portion 114 thereof being embedded in the hollow body 100, during the moulding of that body. As clearly shown in the drawings, the upper portion of the capstan element 102 includes a vertical section 116 and an axial line on the periphery of this vertical section 116 always lies on the vertical axis of rotation of the capstan device 86. Consequently, when the capstan device 86 is rotated, the vertical section 116 gyrates about the axis of rotation, but the vertical section always lies very close to the axis of rotation. Above the vertical section 116, there is an out-turned radial portion 118 which passes through the axis of rotation.

The bore of the lower portion of the drive wharf 82 is formed with a frusto-conical portion 120 and with a groove 122, which has substantially the same cross-sectional shape as that of the rib 108 formed on the body 100 of the capstan device 86. Thus, it is possible to introduce the upper part of the body member 100 into the frusto-conical portion 120 of the bore of the drive wharf 82, and when the rib 108 engages with the smaller diameter upper end of the frusto-conical portion 120, then by exerting upward pressure on the body 100, it is possible to cause that body to contract slightly in diameter, as permitted by its resilience and by the gap 104, until the rib 108 has passed over the obstruction provided by the narrow bore end of the frusto-conical portion 120 and engaged in the groove 122. In other words, the hollow body 100, is a snap-in fit in the drive wharf 82. In order to assist in the snap-in fitting, it may be desirable for the operative to squeeze the hollow body 100 in the hand, in order to slightly close up the gap 104. When it is required to detach the capstan device 86 from the drive wharf 82, the body 100 is gripped by the operative, and simply pulled vertically downwards, whereupon, the body 100 contracts again slightly, to allow the rib 108 to pass over the obstruction provided by the small diameter end of the frusto-conical portion 120.

The yarn 50 is wrapped around the vertical section 116 of the capstan element 102 as shown in FIG. 1, in order to provide the tension relieving effect. In fact, the winding or wrapping of the yarn around the capstan element will be discussed in greater detail hereinafter. Because of the capstan effect produced by the wrapping of the yarn 50 around the capstan element 102, the tension in the section of the yarn between the tension reliever 60 and the nip of the front rollers 40 and 42 is only a small faction of the tension in the yarn below the tension reliever 60. Hence, whilst it is possible to operate the spinning machine to produce the desired tension in the spinning balloon 52, that tension is not transmitted back to the weak region of the yarn where it emerges from the nip of the front rollers 40 and 42. Consequently, the incidence of yarn breakage at weak position is very much reduced, and practical trials have confirmed this.

Clearly it is essential to ensure that at least some twist is introduced into the yarn between the nip of the front rollers 40 and 42 and the tension reliever 60, since otherwise the provision of the tension reliever 60 would simply have shortened the length of yarn in which twist is being inserted. Because the capstan element 102 rotates about the longitudinal axis which is coincident with the general direction of the yarn path, twist is in fact introduced into the upper section of the yarn between the delivery rollers and the tension reliever and the driving arrangement comprising the belt 70, the driving roller 64 and the drive wharf 82, is so arranged, that this twist is inserted at virtually the same rate as in the section below the tension reliever. In practice, it is not essential to rotate the tension reliever at precisely the same angular velocity as the spinning balloon, since so long as a substantial amount of twisting takes place as the yarn is travelling from the front rollers 40 and 42 to the tension reliever 64, that suffices. In other words there could be a small difference between the amount of twist inserted above and below the tension reliever, without materially affecting the overall performance of the spinning operation.

In a practical test a single spindle station on a ring spinning machine was modified in accordance with the apparatus described above, and then identical yarns were spun at this station and on other conventional spinning stations not equipped with the tension reliever device on the machine. Once spinning was in progress, the yarn being produced was gradually weakened by reducing the twist. One by one, the yarn ends broke at the conventional spindles, whilst at the modified spindle position, spinning continued. This process has been repeated several times, and proves the effectiveness of the tension reliever in reducing end breakage rate in a ring spinning apparatus.

FIG. 8 illustrates an alternative form of capstan device 186, having a body member 200 identical with the body member 100. In this construction however, there is a capstan element 202 which is generally of Z-shape. The lower end of the capstan element 202 is embedded in the body 200, the upper end 218 forms a hook portion, and the intermediate portion 216 lies close to the vertical axis about which the device 186 is rotated. In fact, with this construction, the section 216 of the element 202 may be inclined to the vertical, and pass through the axis of rotation from one side to the other. Apart from the difference in the shape of the capstan element itself, the device illustrated in FIG. 8 is the same as that illustrated in FIG. 4, and it is operated in the same manner.

In FIG. 9, there is illustrated a method of wrapping the yarn 50 two complete convolutions around the capstan element 102. It will be observed, that the lower radial portion of the capstan element prevents the yarn convolutions sliding off the lower end of the capstan element, whilst the hook portion 118 prevents the convolutions of yarn sliding off the top end of the capstan element. Hence, the two convolutions are firmly maintained on the capstan element, and the yarn has a contact with the vertical section of the capstan element, through an angle of $4\pi$ radians. With this arrangement, due to the large angle of contact between the yarn and the capstan element, the capstan effect is very pronounced indeed, and the tension differential between the yarn below and above the tension reliever will be very high.

FIG. 10 illustrates a winding arrangement which is similar to that shown in FIG. 9, excepting that in this case, the yarn 50 is only wound one convolution around the capstan element 102, whereby its angle of engagement with the capstan element is $2\pi$ radians. Hence, although there is a considerable capstan effect, it is not so pronounced as that obtained with the arrangement illustrated in FIG. 9.

Turning now to FIG. 11, there is shown a winding arrangement with a capstan device of the type illustrated in FIG. 8, having a capstan element 202. The yarn 50 is wound around the intermediate portion 216 with a single convolution, but in fact, owing to the shape of the capstan element 202 and the method of winding, the angle of engagement of the yarn with the capstan element is approximately $3\pi$ radians. This arrangement therefore gives a capstan effect, stronger than that illustrated in FIG. 10, but not so strong as that illustrated in FIG. 9. Finally, FIG. 12 illustrates a winding arrangement, in which the yarn passes straight through the capstan element 202, engaging on one side of the lower radial portion, and on the opposite side of the other radial portion, being hooked into the two acute angles formed in the element 202. The engagement of the yarn with the capstan element in this case is approximately $\pi$ radians, and consequently, the capstan effect is considerably reduced, and certainly less than that even with the FIG. 10 arrangement. Nevertheless, the capstan effect of the FIG. 12 arrangement will be effective for certain yarns.

It is possible therefore, to vary the tension differential provided by the tension reliever, either by altering the winding configuration of the yarn, and/or by changing the capstan device. In this connection, it will be understood that it is a relatively simple matter to change from one form of capstan device to the other, because it is only necessary to release one capstan device, and insert the other by the snap-in fitting procedure.

It will be understood, that the shape of the rod-like capstan element, can be varied from the two shapes illustrated in FIGS. 4 and 8, in order to obtain modified capstan effects, and in addition, capstan devices can be employed, in which the capstan element has a serrated or otherwise treated surface, to increase the gripping effect of the capstan element on the yarn.

It is to be understood however, that the invention could be applied to other types of continuous spinning apparatus, such as flyer or cap spinning machines.

I claim:

1. In a textile spinning machine a tension reliever comprising a drive wharf mounted for rotation about its own axis and a capstan device itself comprising a hollow body and a capstan element for a yarn, said capstan element being carried by said hollow body, said capstan device being releasably connected with said wharf in a manner such that it is supported for rotation with said wharf to cause rotation of said capstan element but can be completely and readily removed from said wharf for the purpose of threading-up the yarn through said capstan device and into engagement with said capstan element.

2. In a textile spinning machine, a tension reliever according to claim 1 wherein said hollow body has a snap-in connection with said wharf.

3. In a textile spinning machine, a tension reliever according to claim 1 wherein said hollow body is formed with a slot in its wall, said slot extending from end-to-end of said hollow body so that the yarn can be introduced radially through the wall of the hollow body.

4. In a textile spinning machine, a tension reliever according to claim 1 further comprising a hollow axle and a journal bearing on said hollow axle, said wharf being mounted on said journal bearing for rotation about said hollow axle.

5. A tension reliever for use in a textile spinning machine comprising a hollow axle, a substantially cylindrical wharf rotatably mounted on said hollow axle, a substantially cylindrical hollow body formed with a slot extending from end-to-end thereof, a capstan element carried internally of said hollow body, said hollow body and said wharf having snap-in interconnection, whereby when said hollow body is connected to said wharf it is rotatable with said wharf for rotating said capstan element but said hollow member with said capstan element is completely and readily removable from said wharf for the purpose of threading-up the yarn.

6. A tension reliever for use in a textile spinning machine according to claim 5 wherein at least one of said wharf and said hollow body is made of resilient material which will permit temporary distortion for making the snap-in connection.

7. A spinning machine having a yarn delivery position and a twist inserting device in which a tension reliever is located between said yarn delivery position and said twist inserting device, said tension reliever comprising a hollow body mounted for rotation about an axis substantially coincident with the path of yarn, and a capstan element carried by said hollow body, said capstan element comprising a rod having a yarn engaging section extending close to the axis of rotation of said hollow body and a hook portion at the distal end of said yarn engaging section for preventing yarn sliding off said yarn engaging section.

8. A spinning machine according to claim 7 wherein said capstan element has a root section embedded in said hollow body.

9. A spinning machine according to claim 7 wherein said yarn engaging section extends substantially parallel with the rotational axis of said hollow body.

10. A spinning machine according to claim 7 wherein said capstan element is substantially Z-shaped and the said yarn engaging section crosses the rotational axis of said hollow body.

* * * * *